United States Patent [19]

Jerila

[11] 4,193,619

[45] Mar. 18, 1980

[54] DOOR LATCH

[75] Inventor: Torsti T. T. Jerila, Rowland Heights, Calif.

[73] Assignee: Acme General Corporation, San Dimas, Calif.

[21] Appl. No.: 906,261

[22] Filed: May 15, 1978

[51] Int. Cl.[2] ..... E05C 1/06

[52] U.S. Cl. ..... 292/168; 292/DIG. 38

[58] Field of Search ..... 292/168, 166, 143, DIG. 26, 292/DIG. 38

[56] References Cited

U.S. PATENT DOCUMENTS

| | | | |
|---|---|---|---|
| 224,040 | 2/1880 | Prouty | 292/166 |
| 3,360,969 | 1/1968 | Pennings | 292/168 X |
| 3,907,346 | 9/1975 | Van Klompenburg | 292/DIG. 38 |

FOREIGN PATENT DOCUMENTS

| | | | |
|---|---|---|---|
| 57309 | 8/1945 | Netherlands | 292/166 |
| 514536 | 11/1939 | United Kingdom | 292/166 |
| 742903 | 1/1956 | United Kingdom | 292/166 |

*Primary Examiner*—Richard E. Moore
*Attorney, Agent, or Firm*—Christie, Parker & Hale

[57] ABSTRACT

A pair of free linkages are disposed in a door latch housing between the housing, the latch bolt, and the latch bolt actuating buttons. Preferably, each linkage comprises a toggle hinge having first and second sides joined by a pivotable connection in a one piece polypropylene construction. The sides of the hinge taper approaching the pivotable connection so the pivotable connection is substantially thinner than the first and second sides. The taper of the first and second sides differs in alternating fashion across the pivotable connection to form a bearing surface alternately on one side of the pivotable connection and the other. Responsive to the movement of a privacy button to its latched position, movement of one of the actuating buttons is prevented without preventing movement of the other actuating button. Responsive to movement of the other actuating button, the privacy button returns to its unlatched position.

35 Claims, 17 Drawing Figures

Fig. 1
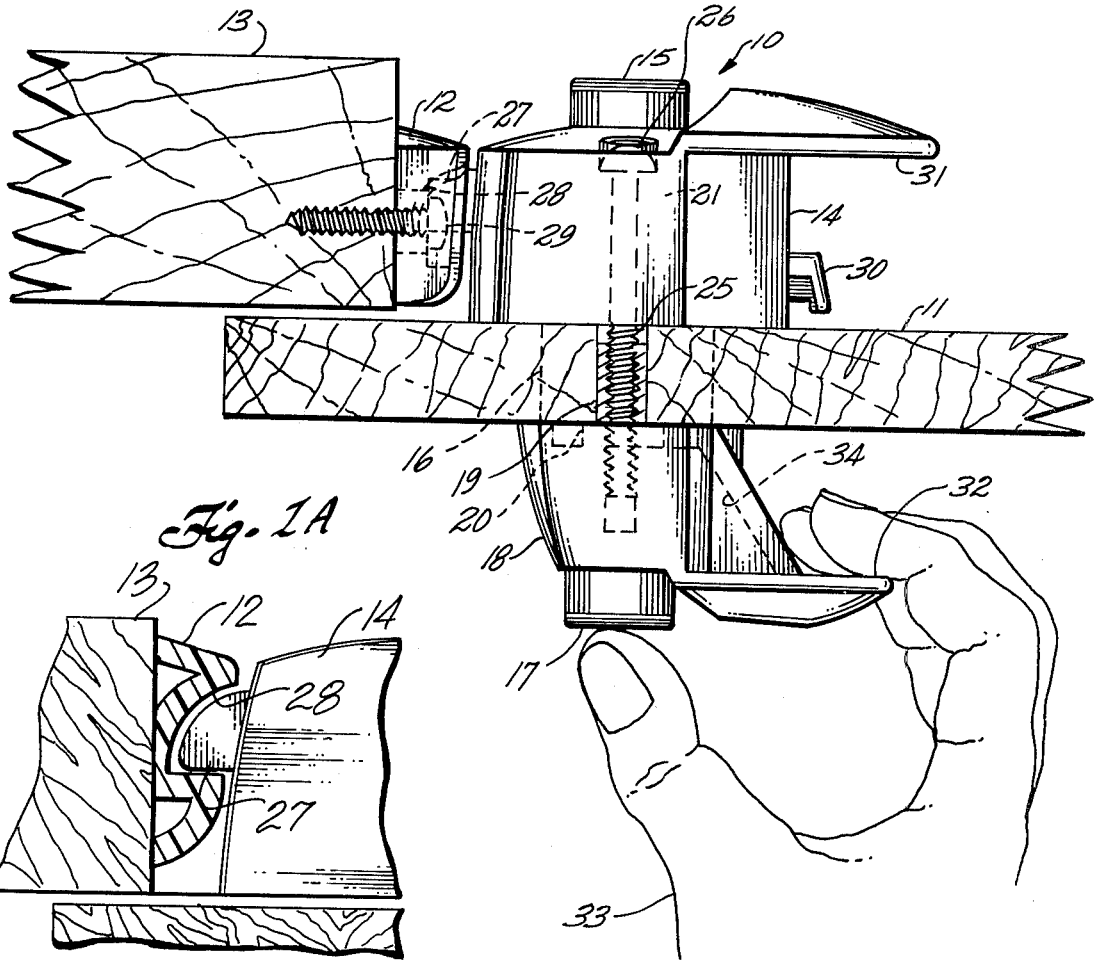
Fig. 1A
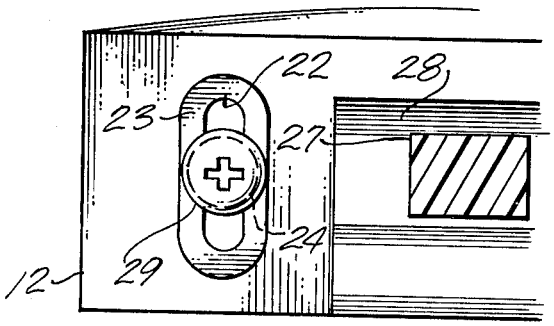
Fig. 1B

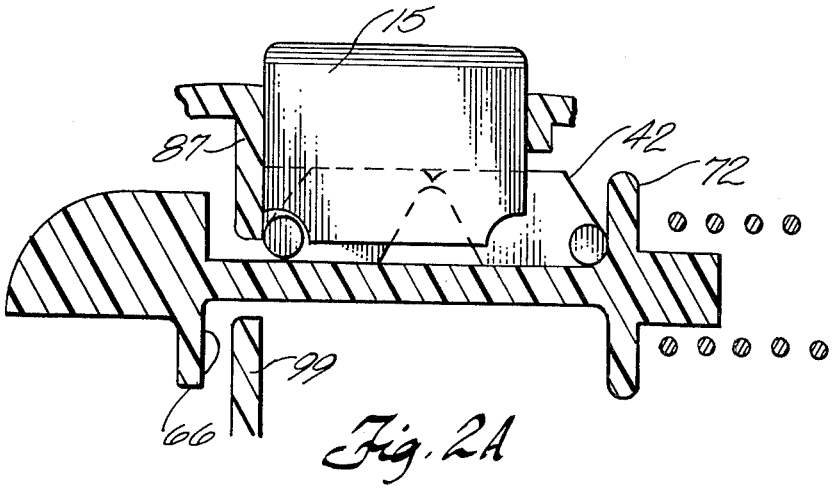
Fig. 2A
Fig. 2B
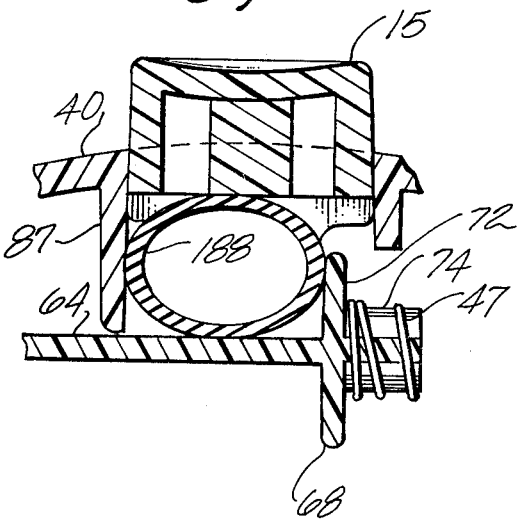

Fig. 4A
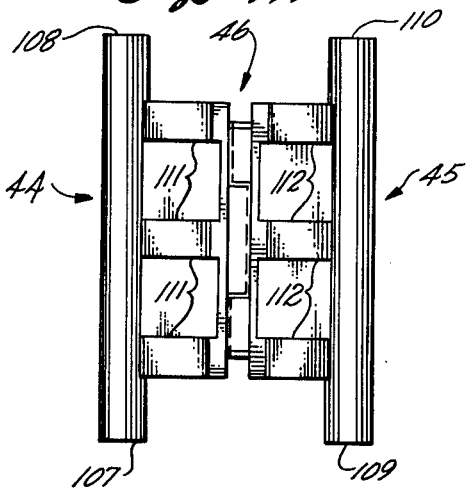
Fig. 4B
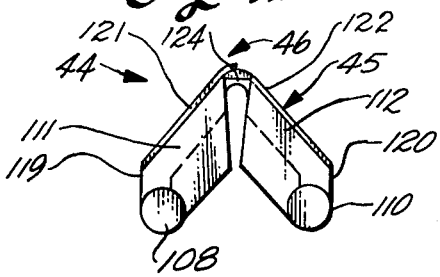
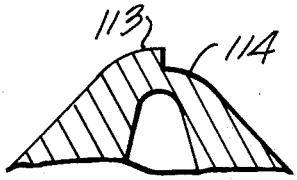
Fig. 4E
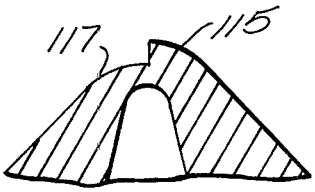
Fig. 4D
Fig. 4C
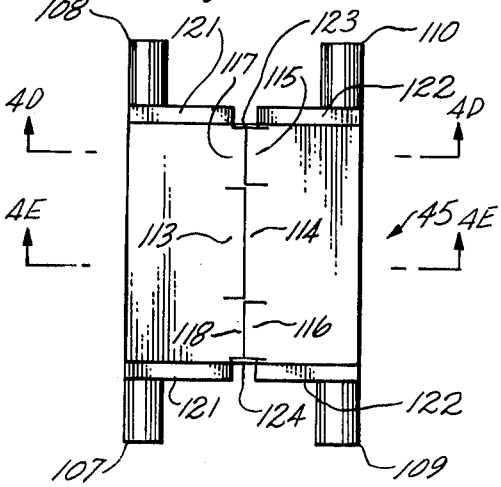

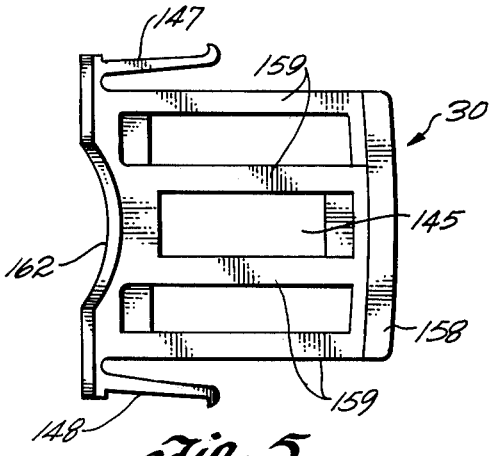
Fig. 5
Fig. 6
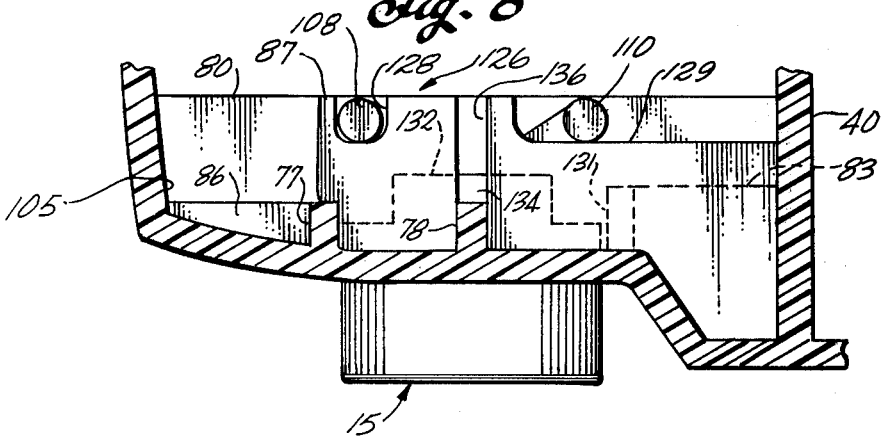

DOOR LATCH

BACKGROUND OF THE INVENTION

This invention relates to hardware and, more particularly, to a door latch well suited for use on recreational vehicles, boats, screen doors, and other locations exposed to moisture.

Conventionally, a door latch has a latch bolt supported inside a housing to slide between an extended position and a retracted position. A spring biases the latch bolt into its extended position to engage a strike plate when the door is closed. The latch bolt slides to its retracted position to permit opening of the door when an actuating button is pushed or turned.

On recreational vehicles, boats, screen doors, and other locations exposed to moisture where security is not a requirement, a corrosion resistant door latch made principally from interlocking molded plastic parts provides an effective low cost approach.

A privacy latch is a desirable feature in a number of applications, particularly bathrooms and toilets. This feature in a door latch permits the door to be opened from only one side when a privacy button is depressed.

SUMMARY OF THE INVENTION

The invention concerns a door latch construction having free but interlocking parts, for the most part preferably molded from plastic.

According to one aspect of the invention, a free linkage is disposed in a door latch housing between the housing, a slidable latch bolt, and a movable latch bolt actuating button accessible from the outside of the housing. The latch bolt is biased into its extended position by a spring. Responsive to movement of the actuating button, the latch bolt slides into its retracted position in opposition to the spring due to the coupling between the actuating button and the latch bolt provided by the free linkage. Preferably, the free linkage is a one piece molded polypropylene toggle hinge having first and second sides joined by a pivotable connection to form first, second, and third bearing areas at the end of the first side, at the end of the second side, and at the pivotable connection, respectively. The first bearing area bears against the housing, the second bearing area bears against the latch bolt, and the third bearing area bears against the actuating button. The latch bolt and housing cooperate to capture the end of the first side and to guide the end of the second side, thereby controlling the position of the toggle hinge during operation without attachment to the parts of the door latch.

According to another aspect of the invention, a privacy latch for a door has on one side of the door a first button movable between a first position and a second position, on the other side of the door a second button movable between a first position and a second position, a latch bolt spring biased into its extended position, and a privacy button accessible from the first side of the door. The first and second buttons are independently coupled to the latch bolt such that the first and second buttons are spring biased into their first position, and the latch bolt slides into its retracted position responsive to movement of either one of the buttons to its second position in opposition to the spring bias. Responsive to movement of the privacy button from its unlatched position to its latched position, movement of the second button from its first position to its second position is prevented without preventing movement of the first button to its second position. Responsive to movement of the first button from its first position to its second position, the privacy button moves from its latched position to its unlatched position.

According to still another aspect of the invention, a privacy latch for a door has a first push button on a first side of the door slidable along a first axis between a first position and a second position, a second push button on a second side of the door slidable along a second axis parallel to the first axis between a first position and a second position, a latch bolt slidable along a third axis transverse to the first and second axes between an extended position and a retracted position, a spring for biasing the latch bolt into its extended position, and a privacy button on the first side of the door slidable along a fourth axis parallel to the third axis between an unlatched position and a latched position. Responsive to the sliding of the privacy button from its unlatched position to its latched position, sliding of the second push button from its first position to its second position is prevented. Preferably, a surface on the privacy button in its latched position abuts the second push button in the path to its second position to block sliding thereto, and a surface on the latch bolt pushes the privacy button from its latched position to its unlatched position as the latch bolt slides from its extended position to its retracted position. These functions are made possible by the orientation of the fourth axis, i.e., the sliding axis of the privacy button, parallel to the sliding axis of the latch bolt and transverse to the sliding axis of the second push button.

BRIEF DESCRIPTION OF THE DRAWINGS

The features of a specific embodiment of the best mode contemplated of carrying out the invention are illustrated in the drawings, in which:

FIG. 1 is a top sectional view of a door and door jamb with a door latch having a privacy button incorporating the principles of the invention;

FIG. 1A is a top sectional view of part of the door and door jamb of FIG. 1 showing in more detail the engagement of the latch bolt and the strike plate;

FIG. 1B is a side view of the strike plate in a plane extending through the latch bolt;

FIG. 2A is a top sectional view of a portion of the door latch shown in FIG. 2 when the push button is fully depressed;

FIG. 2B is a top sectional view of a portion of the door latch of FIG. 2 showing an alternative form of free linkage;

FIGS. 4A, 4B, and 4C are, respectively, a bottom plan view, a side elevation view, and a top plan view of one of the toggle hinges shown in FIG. 2;

FIGS. 4D and 4E are sectional views of part of the toggle hinge shown in FIGS. 4A, 4B, and 4C;

FIG. 5 is a bottom plan view of the privacy button shown in FIG. 2;

FIG. 6 is a sectional view of a portion of the case taken through plane 6—6 in FIG. 8;

DETAILED DESCRIPTION OF THE SPECIFIC EMBODIMENT

Figure 2:
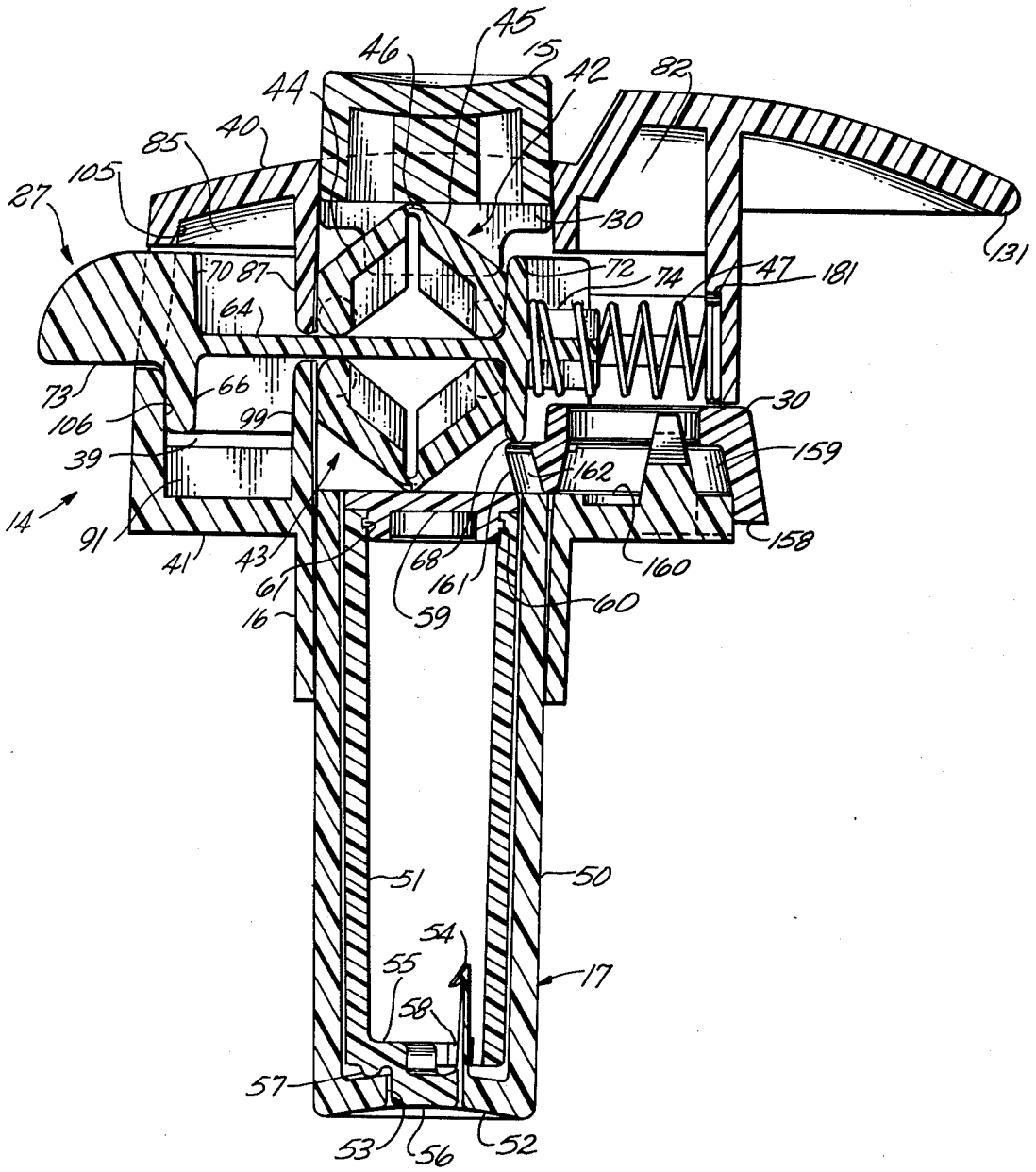
FIG. 2 is a top sectional view of a portion of the door latch of FIG. 1.

In FIG. 1, a door latch 10 is mounted on a door 11, and a strike plate 12 is mounted on a door frame 13. Reference is made to my design application Ser. No. 768,215, filed Feb. 14, 1977, which is assigned to the assignee of the present application, for a disclosure of the ornamental aspects of door latch 10. The disclosure of this application is incorporated herein fully by reference. Door latch 10 has a housing 14 on the inside of the door. An inside push button 15 normally extends from housing 14 on the inside of door 11. Housing 14 has a collar portion 16 that fits in a bore passing through door 11. An outside push button 17 extends from collar portion 16 to the outside of the door. A handle 18 disposed on the outside of door 11 has a pair of sleeve portions, such as that designated 19, on either side of collar portion 16, which lie in bores passing through door 11. Outside push button 17 passes through an opening 20 in handle 18. Screws such as that designated 25 pass through bores in housing 14 and are threaded into sleeve portions 19 to secure housing 14 and handle 18 of door latch 10 to door 11. The heads of screws 25 are recessed in counter bores, such as that designated 26. A slidable latch bolt disposed inside housing 14 is spring biased to its extended position shown in FIG. 1. Strike plate 12 has a recess 28 adapted to engage latch bolt 27 and is secured to the edge of frame 13 by recessed screws, such as that designated 29 on either side of recess 28. As shown in FIG. 1B, strike plate 12 has an elongated opening 22 through which screw 29 passes, and an elongated recess 23 in which the head of screw 29 lies. A pointed annular ridge 24 protrudes from the underside of the screw head. Thus, when screw 29 is screwed into door 13, ridge 24 bites into the material of recess 23 to fasten strike plate 12 to door 13 without slippage. When door 11 is closed, latch bolt 27 engages recess 28 of strike plate 12. A slidable privacy button 30 extends from housing 14 in a direction opposite to latch bolt 27. Latch bolt 27 and privacy button 30 slide along parallel axes. Push buttons 15 and 17 slide along parallel axes that are perpendicular to the axes along which latch bolt 27 and privacy button 30 slide. When privacy button 30 is unlatched, door 11 can be opened or door latch 10 operated from either side. From the inside, the user curls his fingers around the underside of a gripping portion 31 of housing 14 while pressing down on push button 15 with his thumb to retract latch bolt 27 in opposition to the spring bias. From the outside, the user similarly curls his fingers around the underside of a gripping portion 32 of handle 18 while pressing down on push button 17 with his thumb to retract latch bolt 27 in opposition to the spring bias. When latch bolt 27 is retracted, it is free to move away from strike plate 12 to open door 11. A user's hand designated 33 is shown in the position for opening door 11 from the outside. The user's hand is similarly positioned to open the door from the inside. Except for emergency opening means described below, when privacy button 30 is latched, door 11 can only be opened from the inside, i.e., when push button 15 is depressed. Handle 18 has a concavity 34 around push button 17. This permits door latch 10 to be mounted on thicker doors without rendering push button 17 inaccessible from handle 18.

With reference to FIG. 2, housing 14 comprises a case 40 and a case insert 41, which fits into case 40. Case 40 has a parts cavity 39 that is enclosed when case insert 41 fits together with case 40. Toggle hinges 42 and 43 having a one-piece construction are disposed inside housing 14. As shown for toggle hinge 42, each toggle hinge has a side 44 and a side 45 joined by a pivotable connection 46. The end of side 44 has a bearing surface abutting housing 14, the end of side 45 has a bearing surface abutting latch bolt 27, and pivotable connection 46 has a bearing surface abutting the push button (15 or 17). A compression spring 47 extends between housing 14 and latch bolt 27 to bias latch bolt 27 into its extended position shown in FIG. 2. By virtue of the biasing action of spring 47, housing 14, latch bolt 27, and push buttons 15 and 17 bear against the described bearing surfaces of toggle hinges 42 and 43 when latch bolt 27 is in its extended position. When one of the push buttons (15 or 17) is depressed, pivotable connection 46 of the corresponding toggle hinge (42 or 43) moves vertically, as viewed in FIG. 2, and the corresponding toggle hinge (42 or 43) is flattened; the end of side 45 moves horizontally to the right, as viewed in FIG. 2, i.e., transverse to the movement of pivotable connection 46 to push latch bolt 27 to the right, as viewed in FIG. 2, in opposition to the bias of spring 47 to its retracted position. Thus, the door latch is open. Meanwhile, the end of side 45 of the other toggle hinge (42 or 43) loses contact with latch bolt 27. Thus, toggle hinges 42 and 43 serve as free linkages that independently couple push buttons 15 and 17 to latch bolt 27 in that when either push button is depressed, latch bolt 27 slides to its retracted position without depressing the other push button, and when latch bolt 27 is depressed, it moves to its retracted position without depressing push buttons 15 and/or 17. As used here, the term "free linkage" means a linkage that is physically unattached or unconnected to the parts of the door latch that it couples.

When privacy button 30 is in its unlatched position, latch bolt 27 can be retracted from either side of the door by depressing push button 15 or 17. When the user slides privacy button 30 to the left to its latched position as shown in FIG. 2, it abuts the end of push button 17 to block its depression, thereby preventing a user from opening the door latch from outside. When a user on the inside wishes to open the door latch, he depresses push button 15, which slides latch bolt 27 to its retracted position and also slides privacy button 30 to its unlatched position, thereby permitting the door latch to be opened from either side once again.

Push button 17 comprises an outer member having a long cylindrical portion 50 and an inner member having a hollow cylindrical portion 51 inside portion 50. Portion 50 has a concave end portion 52 with a central opening 53. An integral barb 54 extends into the interior of cylindrical portion 50 from the edge of opening 53. Cylindrical portion 51 has an end portion 55 adjacent to end portion 52 and is open at the other end. A protrusion 56 on end portion 55 extends into opening 53. A nipple 57 on end portion 55 to one side of protrusion 56 serves as a spacer, and an opening 58 on end portion 55 to the other side of protrusion 56 receives barb 54. Barb 54 serves to hold the inner and outer members of push button 17 together during assembly. A cap 59 has an integral snap ring 60 that engages a groove 61 on the inside of the open end of cylindrical portion 51 to establish a snap fit between cap 59 and portion 51. Cap 59 is the portion of push button 17 which abuts toggle hinge 43. When privacy button 30 is in its latched position, the door latch can be opened from outside in case of emergency by depressing protrusion 56, which depresses the inner member, including cylindrical portion 51 without depressing the outer member, including cylindrical portion 50.

With the exception of spring 47 and screws 25 (FIG. 1), the parts of the described door latch can all be made of molded plastic. These parts interlock when assembled to capture them and guide and control their movement during operation of the door latch in the manner described below in connection with the detailed description of the specific parts. This molded plastic interlocking construction facilitates fabrication and assembly of the parts and results in a door latch that is corrosion resistant. The parts of the described door latch can also be made from zinc or aluminum by means of die casting.

Figure 3A:
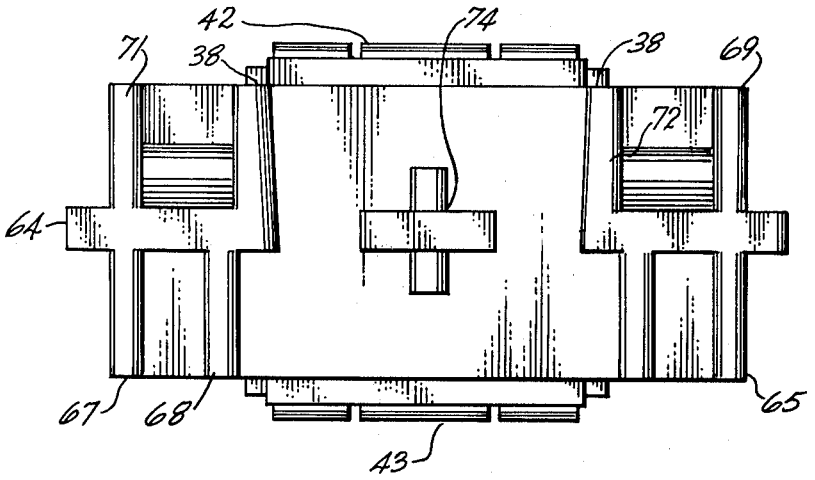
FIGS. 3A and 3B are a right end elevation view and a side elevation view, respectively, of the latch bolt of FIG. 2.
Figure 3B:
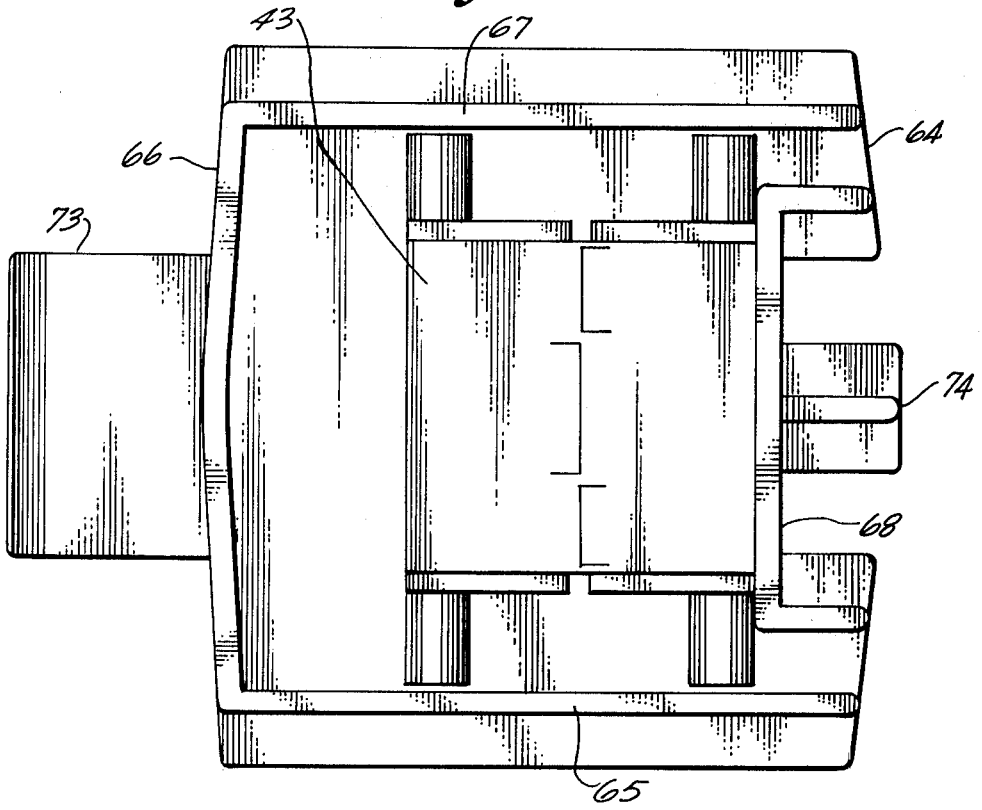

With reference to FIGS. 3A and 3B, latch bolt 27 has in a one piece construction a planar platform 64, sides 65, 66, 67 and 68 on one side of platform 64, sides 69, 70 (FIG. 2), 71, and 72 on the other side of platform 64, a latch portion 73 extending from sides 66 and 70, and a cross-shaped spring keeper 74 extending from sides 68 and 72. Sides 66 and 70 lie on the same plane, and sides 68 and 72 lie on the same plane (FIG. 2). Sides 68 and 72 are bent to form right angles at their ends. Sides 65 and 67 are generally straight, parallel to each other, and spaced outwardly from the ends of side 68. Side 66, which extends between sides 65 and 67, is generally straight and parallel to the center of side 68. Sides 65 through 68 provide a recess in which toggle hinge 43 fits. Similarly, sides 69 and 71 are generally straight, parallel to each other, and spaced outwardly from the ends of side 72. Side 70, which extends between sides 69 and 71, is generally straight and parallel to the center of side 72. Sides 69 through 72 form a recess in which toggle hinge 42 fits.

Figure 8:
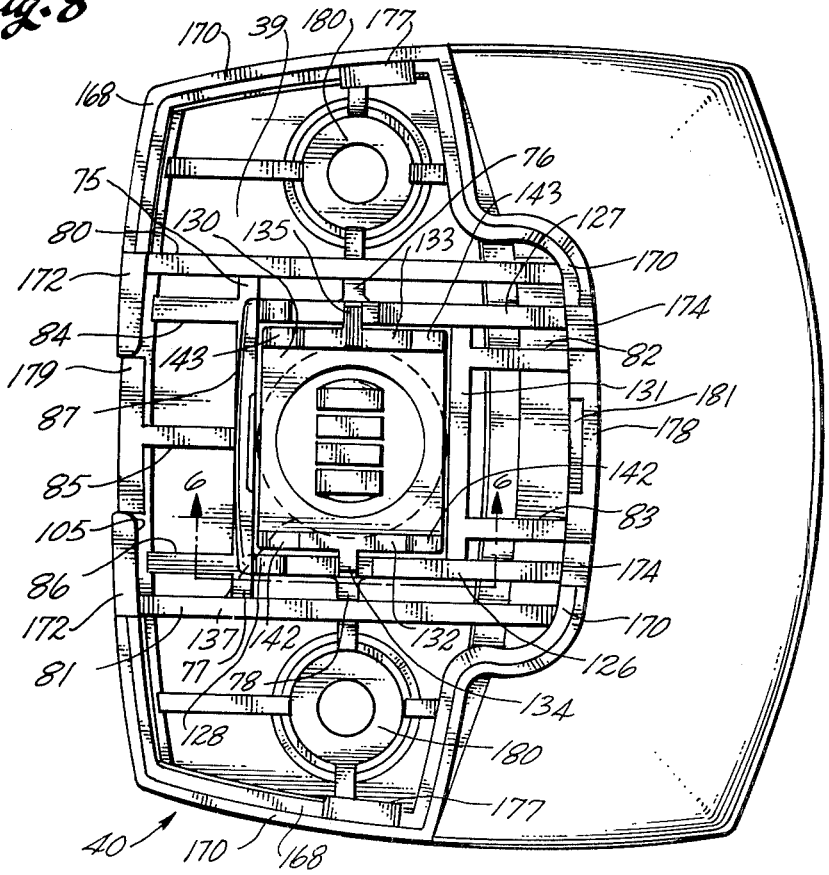
FIG. 8 is a side elevation view of the inside of the case of FIG. 2 with the inside push button in place.

A number of ribs are formed in case 40 and case insert 41 to provide structural strength and to interlock the parts of the door latch, guiding and controlling their movement and capturing the parts to be held stationary. With reference to FIG. 8, tall parallel ribs 80 and 81, intermediate parallel ribs 82, 83, and 85, short parallel ribs 84 and 86, and a tall cross member 87 are formed in cavity 39 of case 40. Short cross ribs 75 and 76 extend inwardly from rib 80 in parallel, and short cross ribs 77 and 78 extend inwardly from rib 81 in parallel. The top of ribs 80 and 81 and member 87 all lie in the same plane. The tops of ribs 75, 76, 77, 78, 84, and 86 all lie in the same plane, below the tops of ribs 82, 83, and 85. The inner surfaces of ribs 80 and 81 abut the outer surfaces of sides 71 and 69, respectively, to guide latch bolt 27 as it slides between its extended position and its depressed position. Also, as latch bolt 27 slides, the edge (designated 38 in FIG. 3A) of the ends of side 72 ride on ribs 82 and 83, respectively, the edge of side 70 rides across rib 85, the ends of platform 64 ride on ribs 80 and 81, respectively, and the center of platform 64 rides across member 87. Thus, ribs 82, 83, and 85 perform a supportive function, and ribs 75, 76, 77, 78, 84, and 86, which are nonsupportive, perform a case strengthening function.

Figure 7:
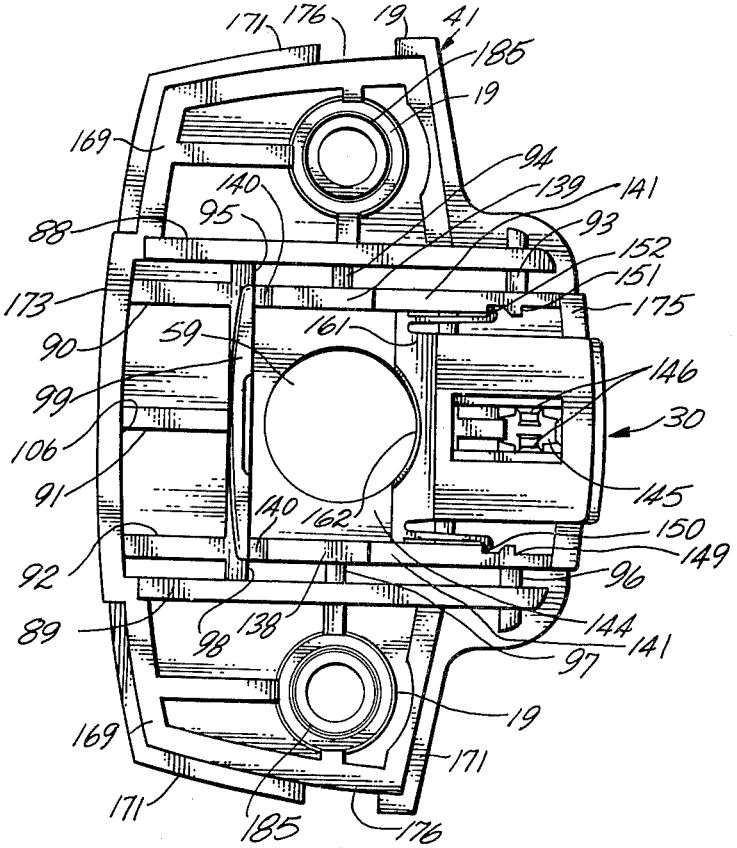
FIG. 7 is a side elevation view of the inside of the case insert shown in FIG. 2 with the outside push button and the privacy button in place.

With reference to FIG. 7, tall parallel ribs 88 and 89, an intermediate rib 91, short parallel ribs 90, and 92, short cross ribs 93, 94, 95, 96, 97, and 98, and a tall cross member 99 are formed inside case insert 41. The top of ribs 88 and 89 and member 99 all lie in the same plane. The tops of ribs 90, 92, 93, 94, 95, 96, 97, and 98 all lie in the same plane, below the top of rib 91. The inner surfaces of ribs 88 and 89 abut the outer surfaces of sides 65 and 67, respectively, to guide latch bolt 27 as it slides between its extended position and its retracted position. Also, as latch bolt 27 slides, the edge of side 66 rides across rib 91, the ends of platform 64 ride on ribs 88 and 89, and the center of platform 64 rides across member 99. In summary, rib 91 performs a supportive function and ribs 90, 92, 93, 94, 95, 96, 97, and 98, which are nonsupportive, perform a case strengthening function.

With reference to FIGS. 4A, 4B, and 4C, sides 44 and 45 and pivotable connection 46 of each of toggle hinges 42 and 43 have a one piece construction and are molded from a plastic that does not fatigue easily, such as polypropylene. Retaining legs 107 and 108 extend outwardly from the end of side 44 in opposite directions perpendicular to the movement of pivotable connection 46 and sides 44 and 45. Guiding legs 109 and 110 extend outwardly from the end of side 45 in opposite directions perpendicular to the movement of pivotable connection 46 and sides 44 and 45. Side 44 has a plurality (three) of strengthening ribs 111 extending perpendicularly from legs 107 and 108 in the direction of pivotable connection 46. Similarly, side 45 has a plurality (three) of strengthening ribs 112 extending perpendicularly from legs 109 and 110 toward pivotable connection 46. In the region where sides 44 and 45 approach and join each other to form pivotable connection 46 they taper so pivotable connection 46 is substantially thinner than sides 44 and 45 (FIG. 4B). This taper differs in alternating fashion across pivotable connection 46 (FIG. 4C). Side 44 has a tapered portion 113 that is thicker than the adjoining tapered portion 114 of side 45. Similarly, side 45 has tapered portions 115 and 116 on either side of tapered portion 114 that are thicker than their respective adjoining tapered portions 117 and 118 on side 44. Consequently, the bearing surface of pivotable connection 46 alternates from one side thereof to the other, i.e., between portions 113, 115, and 116. Thus, portions 113, 115, and 116 provide a thickened bearing surface to accommodate the wear due to contact with push buttons 15 and 17 without a corresponding effective thickness of the material of pivotable connection 46 being bent during operation, which promotes longer life and easy flex of pivotable connection 46. In other words, thickened portions 113, 115, and 116 eliminate wearing on the flexing region at pivotable connection 46. Side 44 has a bearing surface 119 which abuts cross member 87 or 99, and side 45 has a bearing surface 120 which abuts side 68 or 72. At its edges, side 44 has ridges 121. At its edges, side 45 has ridges 122. At the ends of pivotable connection 46, outwardly tapered regions 123 and 124 are formed by the unremoved flash of the molding process to increase the cycle life of the toggle hinge to repeated flexing. The toggle hinges are molded in an angulated position as shown in FIG. 4B, so that when they are flattened during operation of the door latch, their internal elasticity returns them to the angulated position.

The ends of sides 44 and 45 move apart in a direction transverse to pivotable connection 46 in a toggle action. With a one piece polypropylene construction, the preferable ratio of the distance of travel of pivotable connection 46 to the transverse distance of travel of the end of side 45 relative to the end of side 44 is in the range between one and two. In a typical embodiment, this ratio is 1.4.

Case 40 has parallel guide members 126 and 127 extending transversely from the ends of cross member 87. As shown in FIG. 6 for member 126, each of the guide members has a recess 128 in which the respective retaining legs (107 and 108) of side 44 of toggle hinge 42 lie, and an elongated cutout 129 in which the respective guiding legs (109 and 110) of side 45 lie. Platform 64 (not shown) of latch bolt 27 rides on the top of members 126 and 127 to form therewith recesses that capture retaining legs 107 and 108 and retain the end of side 44 as toggle hinge 42 is flattened and to form therewith slots that guide legs 109 and 110 and control the movement of the end of side 45 as toggle hinge 42 is flattened. Toggle hinge 42 is retained laterally by sides 69 and 71 of latch bolt 27 in the manner illustrated in FIG. 3B for toggle hinge 43.

Case insert 41 has parallel guide members 138 and 139 extending transversely from the ends of cross member 99. Each of the guide members has a recess 140 in which the respective retaining legs (107 and 108) of side 44 of toggle hinge 43 lie, and an elongated cutout 141 in which the respective guiding legs (109 and 110) of side 45 lie. Recess 140 and cutout 141 are shaped as recess 128 and cutout 129 (FIG. 6). Platform 64 of latch bolt 27 rides on the top of members 138 and 139 to form therewith recesses that capture retaining legs 107 and 108 and retain the end of side 44 as toggle hinge 43 is flattened and to form therewith slots that guide legs 107 and 108 and control the movement of the end of side 45 as toggle hinge 43 is flattened. As illustrated in FIG. 3B, toggle hinge 43 is retained laterally by sides 65 and 67 of latch bolt 27. Thus, although toggle hinges 42 and 43 are free, i.e., not connected or attached to housing 14, latch bolt 27 or push buttons 15 and 17, they are completely confined and controlled in their movement by latch bolt 27, case 40, case insert 41, and push buttons 15 and 17.

Push button 15 has a rectangular base portion 130 (FIG. 8) that fits in a rectangular recess formed by members 126 and 127, cross member 87, and a short cross rib 131, the top of which is in the same plane as ribs 82 and 83. Sides 132 and 133 extend perpendicularly from the edges of base portion 130. Rails 134 and 135 formed on sides 132 and 133, respectively, ride in slots such as slot 136 (FIG. 6) formed in members 126 and 127. The portion of push button 15 outside case 40 extends through an opening 137 formed in the front of case 40, which is directly behind rectangular portion 130 in FIG. 8. In the fully extended position of push button 15, base portion 130 abuts the inside portion of the front of case 40 surrounding opening 137. Sides 132 and 133 closely embrace pivotable connection 46 and the adjacent portions of sides 44 and 45 to effectively couple push button 15 to toggle hinge 42 without appreciable movement therebetween. Side 132 has cutouts 142 at its ends, and side 133 has cutouts 143 at its ends. One of cutouts 142 and one of cutouts 143, namely, the ones adjacent to recess 128 in members 126 and 127, provide clearance for legs 107 and 108 when the ends of sides 132 and 133 approach platform 64. The other cutout 142 and the other cutout 143 are provided simply to facilitate assembly of push button 15, i.e., either end of sides 132 and 133 can be placed adjacent to cross member 87. When case 40 and case insert 41 are assembled, as shown in FIG. 2, the described parts interlock to accurately guide, closely control, and limit the movement of latch bolt 27, toggle hinges 42 and 43, and push button 15. As illustrated in FIG. 2A, push button 15 is fully depressed when toggle hinge 42 flattens out and ribs 111 abut the surface of platform 64. When push button 15 is fully depressed, the ends of sides 132 and 133 are spaced slightly from the surface of platform 64. Similarly, sides 70 and 66 of latch bolt 27 are spaced slightly from cross members 87 and 99, respectively. Thus, the distance of travel of latch bolt 27 and the distance of travel of push button 15 are limited by the design of toggle hinge 42, namely, by the distance of travel of toggle hinge 42 from its square position to its flattened position, as shown respectively in FIGS. 2 and 2A.

As an alternative to toggle hinges, a resilient tubular free connection could be employed to actuate latch bolt 27 responsive to push button 15, as illustrated in FIG. 1B, or responsive to push button 17.

Push button 17 has a rectangular base portion 144 (FIG. 7) that abuts cross member 99 and members 138 and 139. When push button 17 is fully extended, base portion 144 abuts the inside portion of the front of case insert 41 adjacent to collar 16.

With reference to FIGS. 5 and 7, privacy button 30 has an elongated slot 145 into which a pair of prongs 146 formed in case insert 41 extend to secure privacy button 30. Prongs 146 guide the movement of privacy button 30. The movement of privacy button 30 in the unlatched position is limited by the ends of arms 147 and 148 abutting sidewall 168 (FIG. 8). The movement of privacy button 30 in the latched position is limited by transverse portion 158 abutting case insert 41. Slot 145 is sufficiently long to permit privacy button 30 to slide within the described limits. Flexible arms 147 and 148 with barbed ends extend from the inner end of privacy button 30 toward its outer end. Notches 149 and 150 are formed along the sides of member 138, and notches 151 and 152 are formed along the sides of member 139. When privacy button 30 is in its unlatched position, the barbed ends of arms 147 and 148 engage notches 149 and 151, respectively. When privacy button 30 is in its latched position, shown in FIG. 7, the barbed ends of arms 147 and 148 engage notches 150 and 152, respectively. Notches 149 and 151 provide a resistance to the movement of privacy button 30 between its latched and unlatched positions. Notches 150 together with notches 149 maintain privacy button 30 in its latched position until unlatched by latch bolt 27. Privacy button 30 has a plurality (e.g., four) of parallel ribs 159 that ride on a plurality (e.g., three) of short ribs 160 (FIG. 2) formed in case insert 41. Privacy button 30 also has a transverse portion 158 against which the user's finger presses to slide privacy button 30 into its latched position. As shown in FIG. 2, transverse portion 158 abuts case insert 41 to serve as a stop when privacy button 30 is in its latched position. On its end opposite transverse portion 158, privacy button 30 has a ledge 161 having an arcuate recess 162. When privacy button 30 is in its unlatched position, ledge 161 is adjacent to base portion 144 of push button 17. Push button 17 is, therefore, free to move to its depressed position, thereby flattening toggle hinge 43. When privacy button 30 is in its latched position, ledge portion 161 partially overlies base portion 144 and is inserted between base portion 144 and side 68 of latch bolt 27, thereby preventing movement of push button 17 to its depressed position. The end of side 68 undergirds ledge portion 161 as the user attempts to depress push button 17 when privacy button 30 is in its latched position. By virtue of arcuate recess 162, ledge portion 161 does not overlie cylindrical portion 51 when privacy button 30 is in its latched position. Accordingly, in case of an emergency, privacy button 30 can be unlatched from outside by pushing a pencil or other small object against protrusion 56, thereby pushing cap 59 against toggle hinge 43 without moving cylindrical portion 50. When latch bolt 27 slides to its retracted position either by depressing push button 15 or protrusion 56, side 68 thereof, which abuts ledge portion 161, drives privacy button 30 to its unlatched position.

Case 40 and case insert 41 have a number of interlocking parts that hold them together when assembled. Specifically, case 40 has a peripheral side wall 168 with a ridge 170 within which the edge of case insert 41, designated 171, fits. A side wall 169 on case insert 41 fits inside case 40 in abutment with side wall 168, while edge 171 abuts the side of ridge 170. Case 40 also has a recess 172 in side wall 168 within which a protrusion 173 on side wall 169 of case insert 41 fits, and a recess 174 in side wall 168 within which a protrusion 175 on side wall 169 of case insert 41 fits. Notches 176, into which inward projections 177 from ridge 170 fit, are formed on either side of case insert 41. The tight fit and, to a certain extent, the elastic deformation of these fitting elements maintain case insert 41 interlocked with case 40 prior to installation of the door latch. As an alternative or supplement to the described mechanical interlock of case 40 and case insert 41, these two parts could be bonded by solvent welding, i.e., cemented together, or sonically welded where portions 19 and 180 abut. An annular protrusion 185, which serves as an energy director for sonic welding, is provided on the end of portions 19 (FIG. 7). Case 40 also has rectangular notches 178 and 179 in side wall 168, which with side wall 169 of case insert 41 define rectangular openings through which privacy button 30 and latch bolt 27, respectively, extend to the exterior of housing 14. Case 40 has sleeve portions 180 in alignment with sleeve portions 19 of case insert 41 for receipt of screws 25 (FIG. 1). A plurality (e.g., four) of unnumbered strengthening ribs extend radially from sleeve portions 180 (FIG. 8), and a plurality (e.g., three) of unnumbered strengthening ribs extend radially from sleeve portions 19 (FIG. 7). A recess 181 formed in case 40 adjacent to notch 178 serves to retain the end of compression spring 47 opposite the end retained by spring keeper 74.

The described construction facilitates assembly of the parts of the door latch, which is carried out as follows. Push button 15, toggle hinge 42, and latch bolt 27 are placed in cavity 39 inside case 40 in the order recited with the interior of case 40 facing upward so the assembled parts remain in place. Next, toggle hinge 43 is placed in latch bolt 27 (FIG. 3B) and spring 47 is inserted between spring keeper 74 and recess 181. Then, push button 17, including cylindrical portion 51, and privacy button 30 are placed inside case insert 41 in the order recited, with the interior of case insert 41 facing upward so the assembled parts remain in place, and privacy button 30 is secured by prongs 146 (FIG. 7). Privacy button 30 is placed in its latched position so push button 17 remains in place when the inside of case insert 41 is turned over to face downward. Case insert 41 is then turned over to face downward and interlocked with case 40 to complete the assembly. The interior of case 40 remains facing upward until the assembly is completed. Alternatively, case 40 could be turned over to face downward, relying upon spring 47 to hold the assembled parts in place, while the interior of case insert 41 remains facing upward until the assembly is complete.

In summary, when privacy button 30 is unlatched, latch bolt 27, which is normally biased to its extended position, slides to its retracted position upon depression of either push button (15 or 17); the other push button (15 or 17) does not move. When privacy button 30 is latched, push button 17 cannot be depressed and latch bolt 27 cannot be retracted from outside unless protrusion 56 is pushed as an emergency measure. When privacy button 30 is latched, depression of push button 15 retracts latch bolt 27 and unlatches privacy button 30. If the door is open when privacy button 30 is latched, privacy button 30 becomes unlatched as latch bolt 27 rides over strike plate 12 during door closure.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention. For example, instead of push buttons, the latch bolt could be actuated by turning buttons that are coupled by cams or the like to the latch bolt. If a great deal of latch bolt movement is required, two or more toggle hinges could be placed side by side to provide the desired latch bolt movement. Although the toggle hinges preferably have a one piece construction, they could be constructed of separate, interconnected pieces if desired.

What is claimed is:

1. A door latch comprising:

a housing;

a slidable latch bolt disposed within the housing, the latch bolt being slidable between an extended position in which a portion of the latch bolt lies outside the housing, and a retracted position in which said portion of the latch bolt lies at least partially inside the housing;

spring means for biasing the latch bolt into its extended position;

a movable latch bolt actuating button accessible from the outside of the housing; and a linkage disposed in the housing between the housing, the button, and the latch bolt, the linkage bearing against the housing, the button, and the latch bolt without attachment to the housing, the button, or the latch bolt to slide the latch bolt into the retracted position in opposition to the spring means responsive to movement of the actuating button.

2. The door latch of claim 1, in which the linkage comprises a toggle hinge having first and second sides joined by a pivotable connection to form first, second, and third bearing areas at the end of the first side, at the end of the second side, and at the pivotable connection, respectively, the first bearing area bearing against the housing, the remaining bearing areas bearing respectively against the button and the latch bolt, and the movement of the pivotable connection being transverse to the movement of the ends of the first and second sides.

3. The door latch of claim 1, in which the button is a push button, the housing has a passage opening to the outside of the housing, and the button slidably fits in the passage, the latch bolt being retracted when the push button is depressed into the passage.

4. The door latch of claim 3, in which the second bearing area bears against the latch bolt and the third bearing area bears against the button.

5. The door latch of claim 4, in which the hinge has a one piece construction and the first and second side taper approaching the pivotable connection so the pivotable connection is substantially thinner than the first and second sides.

6. The door latch of claim 5, in which the taper of the first and second sides differs in alternating fashion across the pivotable connection to form the third bearing area alternately from one side of the pivotable connection and the other.

7. The door latch of claim 6, in which the first side of the hinge has a pair of retaining legs extending from its end transversely to the movement of the pivotable connection and the ends of the first and second sides, the latch bolt and the housing cooperating to form recesses in which the pair of retaining legs are captured to retain the end of the first side of the hinge as the push button and the latch bolt move.

8. The door latch of claim 7, in which the end of the second side of the hinge has a pair of guiding legs extending from its end transversely to the movement of the pivotable connection and the ends of the first and second sides, the housing and the latch bolt cooperate to form slots in which the pair of legs ride to guide the end of the second side of the hinge as the push button and the latch bolt move.

9. The door latch of claim 8, in which the hinge is made of polypropylene.

10. The door latch of claim 1, in which the button is a push button, the housing has a passage opening to the outside of the housing, and the button slidably fits in the passage, the latch bolt being retracted when the push button is depressed into the passage.

11. The door latch of claim 1, additionally comprising an additional movable latch bolt actuating button accessible from the outside of the housing; and an additional unattached linkage disposed in the housing between the housing, the additional button, and the latch bolt to slide the latch bolt into the retracted position in opposition to the spring means responsive to movement of the actuating button.

12. The door latch of claim 11, in which the second bearing area bears against the latch bolt and the third bearing area bears against the button.

13. The door latch of claim 11, in which the hinge has a one piece construction and the first and second sides taper approaching the pivotable connection so the pivotable connection is substantially thinner that the first and second sides.

14. The door latch of claim 13, in which the taper of the first and second sides differs in alternating fashion across the pivotable connection to form the third bearing area alternately from one side of the pivotable connection and the other.

15. The door latch of claim 1, in which the first side of the hinge has a pair of retaining legs extending from its end transversely to the movement of the pivotable connection and the ends of the first and second sides, the latch bolt and the housing cooperating to form recesses in which the pair of retaining legs are captured to retain the end of the first side of the hinge as the push button and the latch bolt move.

16. The door latch of claim 15, in which the end of the second side of the hinge has a pair of guiding legs extending from its end transversely to the movement of the pivotable connection and the ends of the first and second sides, the housing and the latch bolt cooperate to form slots in which the pair of legs ride to guide the end of the second side of the hinge as the push button and the latch bolt move.

17. The door latch of claim 1, in which the end of the second side of the hinge has a pair of guiding legs extending from its end transversely to the movement of the pivotable connection and the ends of the first and second sides, the housing and the latch bolt cooperate to form slots in which the pair of legs ride to guide the end of the second side of the hinge as the push button and the latch bolt move.

18. The door latch of claim 1, in which the hinge has a one piece construction.

19. The door latch of claim 18, in which the hinge is made of polypropylene.

20. A privacy latch for a door comprising:

a housing having a first passage opening to a first side of the door and a second passage opening a second side of the door;

a first button fitting in the first passage so as to move between a first position and a second position and to be accessible from the first side of the door;

a second button fitting in the second passage so as to move between a first position and a second position, and to be accessible from the second side of the door;

a latch bolt slidably supported inside the housing, the latch bolt sliding between an extended position in which a portion of the latch bolt lies outside the housing and a retracted position in which said portion of the latch bolt lies at least partially inside the housing;

spring means for biasing the latch bolt into its extended position;

means for independently coupling the first and second buttons to the latch bolt so the spring means bias both the first and second buttons into their first position and the latch bolt slides to its retracted position responsive to movement of either one of the buttons to its second position in opposition to the spring means;

a privacy button accessible from the outside of the housing on the first side of the door, the privacy button being movable between an unlatched position and a latched position;

means responsive to the movement of the privacy button from its unlatched position to its latched position for preventing movement of the second button from its first position to its second position without preventing movement of the first button to its second position; and means responsive to the movement of the first button from its first position to its second position for moving the privacy button from its latched position to its unlatched position.

21. The door latch of claim 20, in which the coupling means comprises a first toggle hinge having first and second sides joined by a pivotable connection to form first, second, and third bearing areas at the end of the first side, at the end of the second side, and at the pivotable connection, respectively, the first bearing area bearing against the housing, the remaining bearing areas bearing respectively against the first button and the latch bolt, and the movement of the pivotable connection being transverse to the movement of the ends of the first and second sides; and a second toggle hinge having first and second sides joined by a pivotable connection to form first, second, and third bearing areas at the end of the first side, at the end of the second side, and at the pivotable connection, respectively, the first bearing area bearing against the housing, the remaining bearing areas bearing respectively against the second button and the latch bolt, and the movement of the pivotable connection being transverse to the movement of the ends of the first and second sides.

22. The latch of claim 21, in which the bearing areas are unattached to the housing, the latch bolt, and the buttons.

23. A door latch comprising:

a housing;

a slidable latch bolt disposed within the housing, the latch bolt being slidable between an extended position in which a portion of the latch bolt lies outside the housing, and a retracted position in which said portion of the latch bolt lies at least partially inside the housing;

spring means for biasing the latch bolt into its extended position;

a movable latch bolt actuating button exposed to the outside of the housing; and a toggle hinge disposed in the housing between the housing, the button, and the latch bolt to slide the latch bolt into the retracted position in opposition to the spring means responsive to movement of the actuating button, the toggle hinge having first and second legs joined by a pivotable connection to form first, second, and third bearing areas at the end of the first leg, at the end of the second leg, and at the pivotable connection, respectively, the first bearing area bearing against the housing, the remaining bearing areas being unattached to and bearing respectively against the button and the latch bolt, and the movement of the pivotable connection being transverse to the movement of the ends of the first and second legs.

24. A privacy latch for a door comprising:

a housing having a first passage opening to a first side of the door and a second passage opening to a second side of the door;

a first push button slidably fitting in the first passage so as to slide along a first axis between a first position and a second position and to be accessible from the first side of the door;

a second push button slidably fitting in the second passage so as to slide along a second axis between a first position and a second position and to be accessible from the second side of the door;

a latch bolt slidably supported inside the housing, the latch bolt sliding along a third axis transverse to the second axis between an extended position in which a portion of the latch bolt lies outside the housing and a retracted position in which said portion of the latch bolt lies at least partially inside the housing;

spring means for biasing the latch bolt into its extended position;

means for independently coupling the first and second push buttons to the latch bolt so the spring means bias both the first and second push buttons into their first position and the latch bolt slides to its retracted position responsive to sliding of either one of the push buttons to its second position in opposition to the spring means;

a slidable privacy button accessible from the outside of the housing on the first side of the door, the privacy button being slidable along a fourth axis parallel to the third axis between an unlatched position and a latched position; and means responsive to the sliding of the privacy button from its latched position to its unlatched position for preventing sliding of the second push button from its first position to its second position.

25. The latch of claim 24, in which the first axis is parallel to the second axis.

26. The latch of claim 25, in which the preventing means prevents the second push button from sliding to its second position without preventing the first push button from sliding to its second position.

27. The latch of claim 26, additionally comprising means for sliding the privacy button to its unlatched position responsive to the sliding of the first push button to its second position to unlatch the latch bolt.

28. The latch of claim 27, in which the preventing means comprises a surface on the privacy button that, in its latched position, abuts the second push button in the path to its second position to block sliding thereto.

29. The latch of claim 28, in which the means for sliding the privacy button comprises a surface on the latch bolt that pushes the privacy button from its latched position to its unlatched position as the latch bolt slides from its extended position to its retracted position.

30. An easily assembled door latch comprising the following free parts:

a first housing member having an inside with a parts cavity and a push button opening;

a second housing member having an inside and a push button opening, the second housing member fitting together with the first housing member to enclose the cavity;

a first push button lying inside the first housing member and extending through the push button opening thereof to the outside;

a second push button lying inside the second housing member and extending through the push button opening thereof to the outside;

a slidable latch bolt lying inside one of the housings;

spring means for biasing the latch bolt lying inside the one housing member with the latch bolt;

a first free linkage disposed inside one of the housing members between such housing member, the corresponding push button, and the latch bolt to couple such push button to the latch bolt;

a second free linkage disposed inside one of the housing members between such housing member, the corresponding push button, and the latch bolt to couple such push button to the latch bolt; and means for retaining the part or parts lying inside one of the housing members to permit such housing member to be turned inside down to be fitted together with the other housing member after the parts are assembled inside the housing members.

31. The door latch of claim 30, in which the first and second free linkages, the latch bolt, and the spring means all lie inside the cavity of the first housing member and the retaining means retains the second push button inside the second housing member.

32. The door latch of claim 31, in which the retaining means comprises a privacy button having an elongated slot and the second housing member has a pair of prongs extending into the slot to engage the privacy button, the privacy button being movable between a latched position and an unlatched position, the privacy button partially overlying the second push button in the latched position.

33. A door latch comprising:

a housing;

a slidable latch bolt disposed within the housing, the latch bolt being slidable between an extended position in which a portion of the latch bolt lies outside the housing, and a retracted position in which said portion of the latch bolt lies at least partially inside the housing;

spring means for biasing the latch bolt into its extended position;

a movable latch bolt actuating button accessible from the outside of the housing; and a toggle hinge disposed in the housing between the housing, the button, and the latch bolt to slide the latch bolt into the retracted position in opposition to the spring means responsive to movement of the actuating button, the toggle hinge having first and second sides joined by a pivotable connection to form first, second, and third bearing areas at the end of the first side, at the end of the second side, and at the pivotable connection, respectively, one bearing area bearing against the housing, the remaining bearing areas bearing respectively against the button and the latch bolt, and the movement of the pivotable connection being transverse to the movement of the ends of the first and second sides, at least two of the bearing areas being unattached to the elements against which they bear.

34. The door latch of claim 33, in which all the first, second, and third bearing areas are unattached to the elements against which they bear.

35. A door latch comprising:

a housing;

a slidable latch bolt disposed within the housing, the latch bolt being slidable between an extended position in which a portion of the latch bolt lies outside the housing, and a retracted position in which said portion of the latch bolt lies at least partially inside the housing;

spring means for biasing the latch bolt into its extended position;

a movable latch bolt actuating button accessible from the outside of the housing; and a toggle hinge of one piece construction disposed in the housing between the housing, the button, and the latch bolt to slide the latch bolt into the retracted position in opposition to the spring means responsive to movement of the actuating button, the toggle hinge having first and second sides joined by a pivotable connection to form first, second, and third bearing areas at the end of the first side, at the end of the second side, and at the pivotable connection, respectively, the first bearing area bearing against the housing, the remaining bearing areas bearing respectively against the button and the latch bolt, and the movement of the pivotable connection being transverse to the movement of the ends of the first and second sides.

* * * * *